US008375857B2

(12) United States Patent
Verlinden et al.

(10) Patent No.: US 8,375,857 B2
(45) Date of Patent: Feb. 19, 2013

(54) METHOD FOR PRINTING WITH DIGITAL PRINTING PRESS HAVING AUTOMATED MEDIA TRANSPORT

(75) Inventors: Bart Verlinden, Tongeren (BE); Konrad Vosteen, Freiburg (DE)

(73) Assignee: Agfa Graphics NV, Mortsel (BE)

( * ) Notice: Subject to any disclaimer, the term of this patent is extended or adjusted under 35 U.S.C. 154(b) by 1274 days.

(21) Appl. No.: 11/913,584

(22) PCT Filed: May 4, 2006

(86) PCT No.: PCT/EP2006/062056

§ 371 (c)(1),
(2), (4) Date: Jun. 25, 2008

(87) PCT Pub. No.: WO2007/073948

PCT Pub. Date: Jul. 5, 2007

(65) Prior Publication Data

US 2009/0025587 A1 Jan. 29, 2009

Related U.S. Application Data

(60) Provisional application No. 60/690,215, filed on Jun. 14, 2005.

(30) Foreign Application Priority Data

May 9, 2005 (EP) ..... 05103833

(51) Int. Cl.
*B41J 3/28* (2006.01)
*B41F 15/16* (2006.01)
*B41F 15/22* (2006.01)

(52) U.S. Cl. ..... 101/485; 101/474; 101/126; 400/23

(58) Field of Classification Search ..... 400/23, 400/48, 31, 141, 355, 58; 101/126, 407.1, 101/474, 485; *B41J 3/28; B41F 15/16, 15/18, B41F 15/20, 15/22, 15/26; B65H 5/08, 5/16*
See application file for complete search history.

(56) References Cited

U.S. PATENT DOCUMENTS 3,026,794 A * 3/1962 Nicholson ..... 101/123
3,857,337 A * 12/1974 Tsuji et al. ..... 101/123
5,017,028 A 5/1991 Harding
(Continued)

FOREIGN PATENT DOCUMENTS

EP 0 074 600 A1 3/1983
JP 63286348 A * 11/1988
(Continued)

OTHER PUBLICATIONS

Official communication issued in the International Application No. PCT/EP2006/062056, mailed on Nov. 3, 2006.

*Primary Examiner* — Leslie J Evanisko
(74) *Attorney, Agent, or Firm* — Keating & Bennett, LLP

(57) ABSTRACT

A digital printer is provided with an automated printing sheet transport system, operating in an intermittent manner of feeding a printing sheet to the digital printer, halting the transport to allow printing onto the printing sheet while the printing sheet is maintained in a fixed position, and removing the printed sheet from the digital printer after printing. The digital printer may be combined with a screen print station, both operating on top of a single printing sheet transport system, to form an integrated multifunctional and hybrid printing press.

8 Claims, 6 Drawing Sheets

U.S. PATENT DOCUMENTS

| | | | | |
|---|---|---|---|---|
| 5,787,804 | A * | 8/1998 | Brasa | 101/114 |
| 6,296,403 | B1 | 10/2001 | Duchovne | |
| 2005/0095046 | A1* | 5/2005 | Beehler | 400/23 |
| 2006/0158468 | A1* | 7/2006 | Yoo et al. | 347/2 |
| 2010/0309492 | A1* | 12/2010 | Baxter | 358/1.8 |

FOREIGN PATENT DOCUMENTS

| | | | |
|---|---|---|---|
| WO | 03/101737 | A1 | 12/2003 |
| WO | 2004/002746 | A1 | 1/2004 |
| WO | 2004/037543 | A2 | 5/2004 |

* cited by examiner

METHOD FOR PRINTING WITH DIGITAL PRINTING PRESS HAVING AUTOMATED MEDIA TRANSPORT

CROSS-REFERENCE TO RELATED APPLICATIONS

This application is a 371 of PCT/EP2006/062056, filed May 4, 2006. This application claims the benefit of U.S. Provisional Application No. 60/690,215, filed Jun. 14, 2005, which is incorporated by reference. In addition, this application claims the benefit of European Application No. 05103833.9, filed May 9, 2005, which is also incorporated by reference.

BACKGROUND OF THE INVENTION

1. Field of the Invention

The present invention relates to a solution for broadening the applicability of digital printing techniques. More specifically, the present invention is related to a digital press adapted for being compatible with other non-digital printing press types.

2. Description of the Related Art

Digital printing is known from the office and home market, where xerography (toner) or ink jet technology are used for document printing. In the wide format printing market, ink jetting is being used for printing signs, advertising at POS (Point of Sale), car fleet decoration, etc.

Outside the office and home market, various printer configurations have been developed for digital printing on various information-carrying materials such as paper, adhesive vinyl, fabrics, and PVC. Two such configurations are the so-called "roll-to-roll" and "flatbed" configurations. In general terms, "roll-to-roll" printers utilize a transport system configured to displace a flexible sheet in a given feed direction with respect to a print head by means of rollers. As for "flatbed" (also called "rigid") printers, their transport system utilizes a rigid support for a sheet (not necessarily flexible) or a rigid sheet driven for back and forward movement with respect to a print head. In all printing technologies, transport systems need to provide a high level of accuracy in registering a sheet (generally, information-carrying material) and ensuring accurate positioning of the print head over the information-carrying material, for precise printing.

The more industrial type digital printers include a "flatbed" type transport system that allows them to print on both flexible and rigid sheets. Some of the printing equipment suppliers active in this market are Inca Digital Printers (e.g., the Columbia Turbo printer), Durst (e.g., the Rho 205 printer), Vutek (e.g., the PressVu UV 180 printer), and Zund (e.g., the UVjet 215c printer). These suppliers provide printers having a flatbed transport system for feeding a printing sheet in a feeding direction and a shuttle system for traversing a print head across the printing sheet in a direction perpendicular to the feeding direction of the printing sheet. The flatbed transport system and the shuttle system cooperate together to make the desired print on the printing sheet as a collection of adjacent print swaths. A print swath is printed when the shuttle system moves the print head across the printing sheet while the flat-bed transport system holds the printing sheet in a fixed position. The flatbed transport system then advances the printing sheet with an increment corresponding to the width of the print swath and a next print swath is printed during a next movement of the shuttle system while the printing sheet is again maintained in a fixed position. The movement of the print head or shuttle system relative to the printing sheet may also be implemented the other way around, i.e., printing of a print swath occurs when the printing sheet moves back and forth while the print head or shuttle system moves with incremental steps between the printing of the swaths. Printers using this approach are known from Inca Digital Printers, e.g., the Columbia flat bed printer. Recent patent literature disclosing flatbed arrangements for digital printers, possibly combined with a roll-to-roll system, includes WO-A 2004/037543 to NUR Macroprinters, WO-A 2004/002746 to Inca Digital Printers, and U.S. Pat. No. 6,296,403 to Scitex Vision. In the patent documents, the direction of movement during which a print swath is printed is often referred to as the fast scan direction, whereas the other direction of movement during which the print head and/or the printing sheet are repositioned relative to each other for enabling printing of a next print swath is referred to as the slow scan direction.

One of the advantages of digital printing as opposed to conventional printing, like offset or screen printing, is that process colors can be printed very easily, i.e., the color information that can be reproduced with a mixture of primary and/or secondary colors such as a combination of Cyan, Magenta, Yellow and blacK. It often requires only one 4-color digital print station to reproduce these colors, whereas it requires four single-color offset or screen print stations to do the same. Digital printing, however, fails to provide acceptable solutions for applications where "industrial inks" as spot colors (e.g., brand color), metallic colors (e.g., gold), conductive material (e.g., copper), varnishes, white pre-coats, etc. are to be printed on an information-carrying material. These industrial inks are often not printable with digital printing technologies or require very specialized and dedicated chemistry or equipment to condition these inks for printing with digital technology. A lot of these industrial inks are nowadays printed with screen printing technology.

It would therefore be advantageous to have a digital printing system that can easily be extended with a conventional printing system to support printing of "industrial inks" inline with the printing of the process colors in the digital printing system.

SUMMARY OF THE INVENTION

In order to overcome the problems described above, preferred embodiments of the present invention provide a digital printer with an automated printing sheet transport system operating in an intermittent manner of feeding a printing sheet to the digital printer, halting the transport to allow printing onto the printing sheet while the printing sheet is maintained in a fixed position, and removing the printed sheet from the digital printer after printing.

In a preferred embodiment of the present invention, the digital printer is equipped with a printing sheet transport system that is fully compatible with the printing sheet transport system of an automated screen printing line.

In another preferred embodiment of the present invention, the digital printer is combined with a screen print station, both integrated with a single printing sheet transport system.

Other features, elements, processes, steps, characteristics and advantages of the present invention will become more apparent from the following detailed description of preferred embodiments of the present invention with reference to the attached drawing.

DETAILED DESCRIPTION OF PREFERRED EMBODIMENTS

While the present invention will hereinafter be described in connection with preferred embodiments thereof, it will be understood that it is not intended to limit the present invention to those preferred embodiments.

Digital Printer

Figure 1:
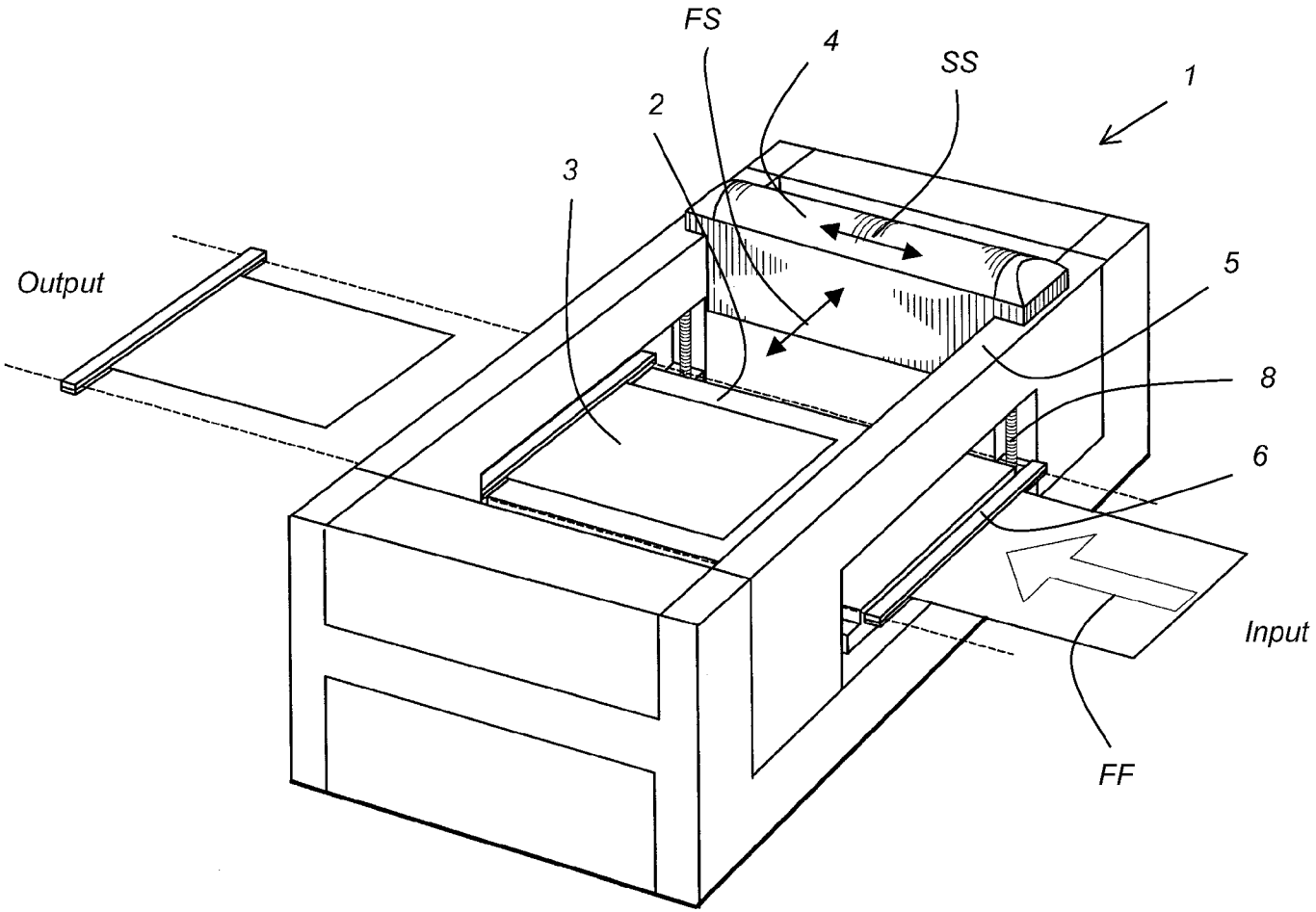
FIG. 1 shows a digital printer according to a preferred embodiment of the present invention.

In FIG. 1, a perspective view of a flatbed digital printer is shown. The digital printer 1 includes a printing table 2 to support a printing sheet 3 during digital printing. The printing table is substantially flat and can support flexible sheets with a thickness down to tens of micrometers (e.g., paper, transparency foils, adhesive PVC sheets, etc.), as well as rigid sheets with a thickness up to several centimeters (e.g., hard board, PVC, carton, etc.). A print head shuttle 4 is designed for reciprocating back and forth across the printing table. Printing is done during the reciprocating operation of the print head shuttle 4. The direction of reciprocating is referred to as the fast scan direction FS. A support frame 5 guides and supports the print head shuttle during its reciprocating operation. A printing sheet transport system can feed a printing sheet into the digital printer along a sheet feeding direction FF that is substantially perpendicular to the fast scan direction of the print head shuttle. The printing sheet transport system is designed as a "tunnel" or "guide through" through the flatbed digital printer, i.e., it can feed a sheet from one side of the printer (right side view in FIG. 1), position the sheet on the printing table for printing, and remove the sheet from the printer at the opposite side (left side view in FIG. 1).

The printing sheet transport system may include a gripper bar 6 that grabs the printing sheet along a leading edge at the input side of the digital printer. Once the gripper bar takes hold of the printing sheet, it pulls it through the printer to finally lay off the printed sheet at the output side of the digital printer.

At the position of the printing table, the printing sheet transport system halts and the gripper bar holding the printing substrate may be aligned with the printing table. Aligning the printing sheet to the printing table may be important in cases where the printing sheet already includes printed data to which the digitally printed data needs to be registered, or in cases where the printing sheet is to receive additional printed data in register to the digitally printed data after removing the printing sheet from the digital printer. The additional data may be a white pre-coat to enhance the color gamut, a spot color image, a varnish to emphasize a particular part of the printed image, etc.

Figure 2:
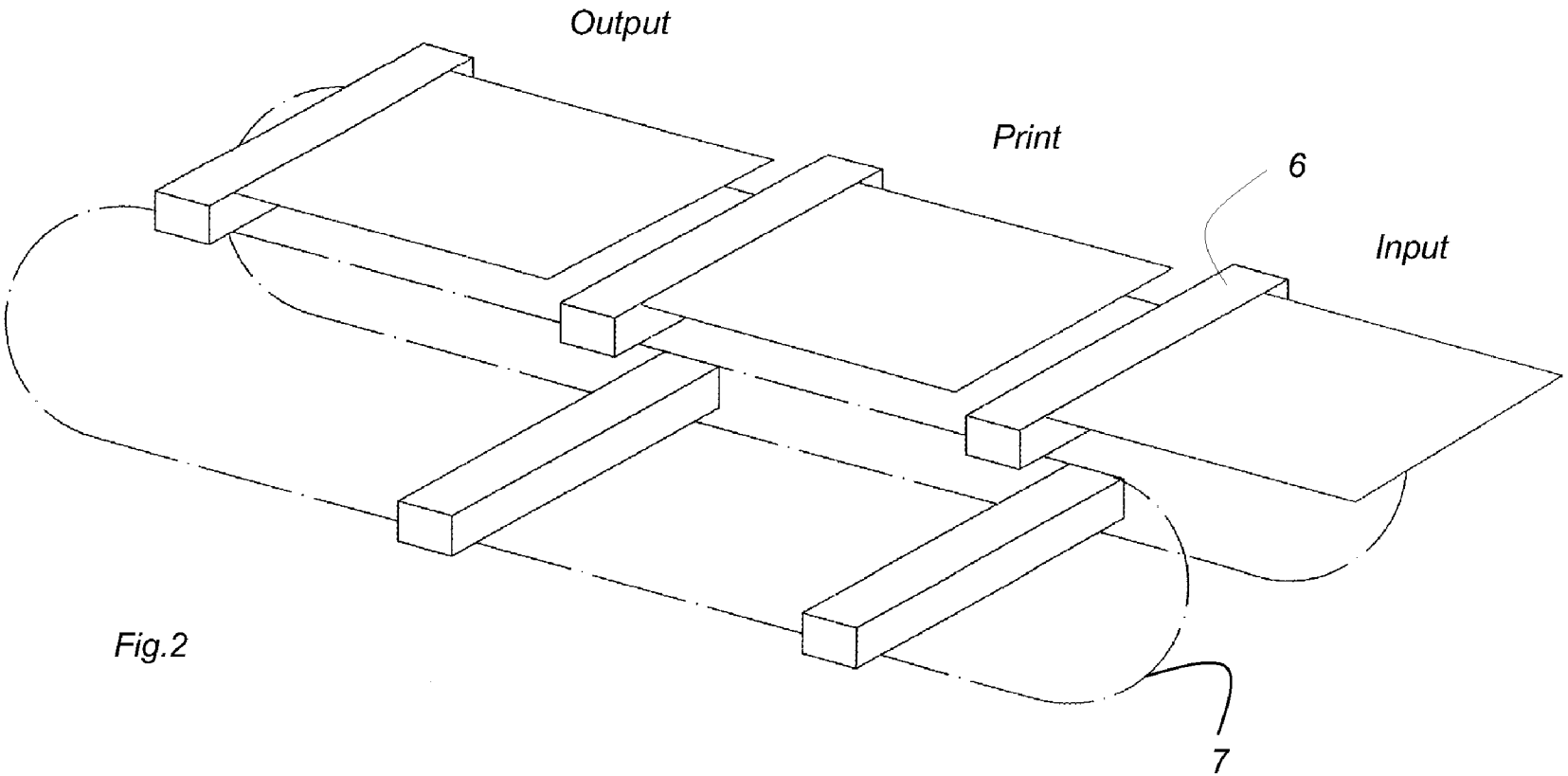
FIG. 2 shows a printing sheet transport system used with the digital printer of FIG. 1.
Figures 3A, 3B, 3C, 3D, 3E, 3F:
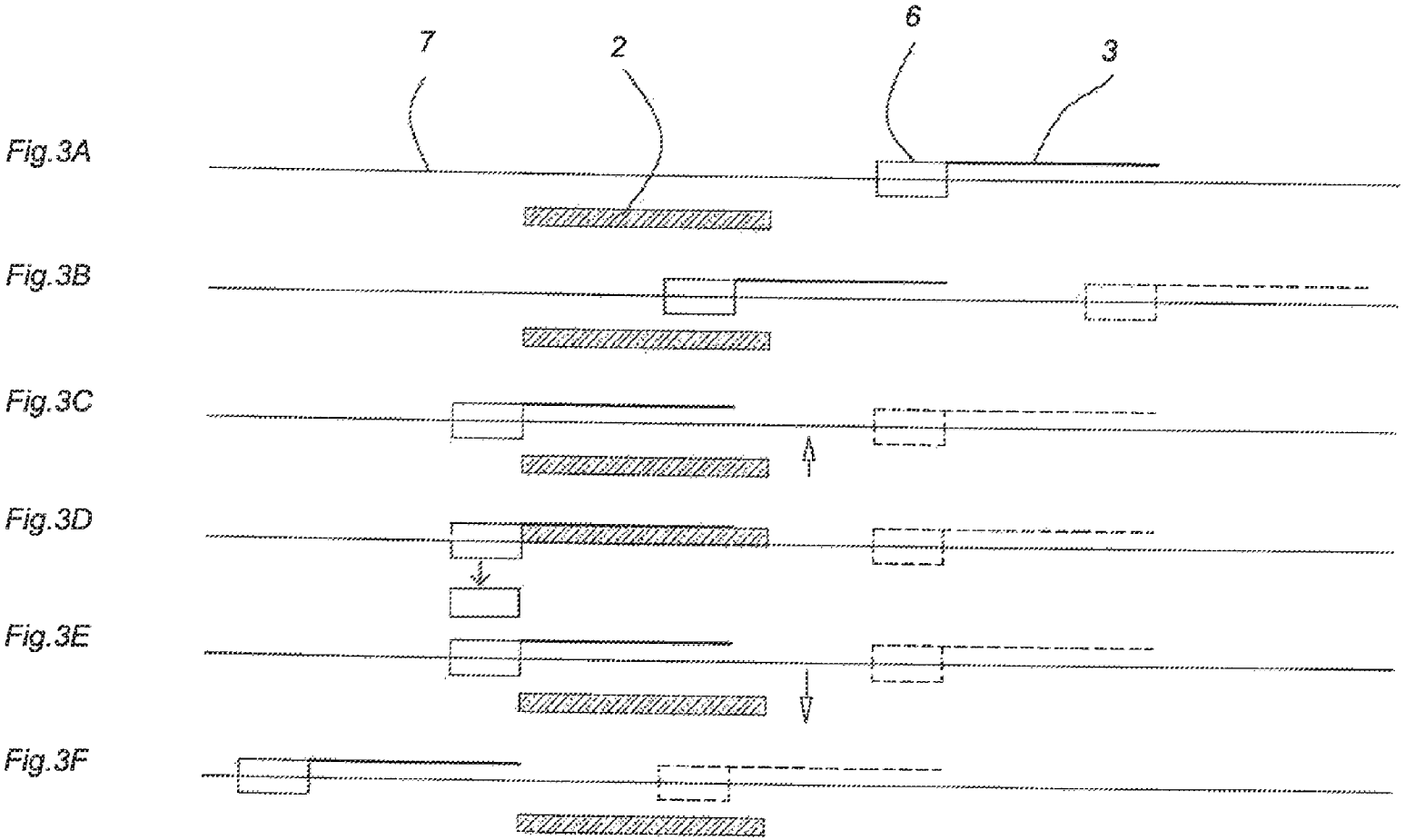
FIGS. 3A through 3F show an operating sequence of the intermittent printing sheet transport according to a preferred embodiment of the present invention.

While the printing sheet is supported by the printing table, the print head shuttle reciprocates over the printing table and prints onto the printing sheet. Before printing, the gripper bar that holds the printing sheet may release the printing sheet and withdraw from its alignment position with the printing table, as shown in FIG. 3D. A reason for doing so may be that, in the aligned position, the gripper bar holding the printing sheet may extend above the printing plane, i.e., the plane including the print surface of the printing substrate, and may physically interfere with the reciprocating print head shuttle. If the gripper bar released the printing substrate prior to printing, it will take hold of the printing sheet again after printing. To do so, the gripper bar will return to its printing table alignment position before grabbing the printing sheet that, at that time, is still supported by the printing table. After printing, the printing sheet transport system resumes operation and removes the printing sheet from the printing table in the direction of the output side of the digital printer. The gripper bar executes a cyclic operation of (1) grabbing a printing sheet, (2) feeding the sheet to the printing table, (3) halting at the print table and possibly releasing the printing sheet during printing, (4) removing the sheet from the printing table after printing, and (5) laying off the printing sheet. The gripper bar may then be transported back to the input side of the digital printer to grab the next printing sheet. Alternatively, multiple gripper bars may be used, positioned at a predefined distance from each other on an endless chain 7, as shown in FIG. 1 and FIG. 2. With an endless chain, a second gripper bar may arrive in a position for grabbing a second printing sheet at the input side of the printer once a first gripper bar has fed a first printing sheet to the printing table. A third gripper bar may arrive in position for grabbing a third printing sheet at the input side of the printer once the second gripper bar has fed the second printing sheet to the printing table, and the first gripper bar has laid off the first printing sheet at the output side of the printer. Once a gripper bar has laid off a printing sheet at the output side of the printer, it is transported back to the input side of the printer via the endless chain. Gripper bars are known from automated multi-color screen printing lines. It may be preferable to include two endless chains, one at each side of the gripper bars, to symmetrically drive or pull the gripper bars at both ends and therefore avoid skew of the gripper bars and their attached printing sheets during printing sheet transport. The endless chain may be embodied as a physical chain or a belt or other suitable endless transport. These endless transports may be driven with suitable structure known in the art, e.g., one motor drive, a driven pulley and a set of supporting pulleys, or multiple synchronized motor drives and associated pulleys. The latter allows better tension control of the endless transport.

As shown in FIG. 1 and FIG. 2, the printing sheet follows a substantially horizontal track from the input side to the output side of the digital printer. The printing table that supports the printing sheet during printing may be vertically adjustable between a printing position and a sheet transport position to allow the gripper bars pulling forward a printing sheet to pass over the table along a substantially horizontal track. Any suitable structure may be used to adjust the vertical position of the printing table, e.g., a set of vertically oriented spindles 8 at each of the corners of the printing table may be used for moving each of the corners of the printing table up or down. Other preferred embodiments may be used for adjusting the vertical position of the printing table such as electric or pneumatic driven piston devices pushing the printing table against gravity, from underneath at a center position of the table. The interactions between the printing table adjustments and the gripper bar transport are illustrated in the FIGS. 3A to 3F. In FIGS. 3A and 3B, the printing table is in a sheet transport position and the gripper bar is allowed to pass over the printing table. When the gripper bar has passed the printing table as shown in FIG. 3C, the printing sheet transport system halts and the printing table moves upward towards the printing position. In the printing position shown in FIG. 3D, the gripper bar is aligned with the printing table and the printing table fully supports the printing sheet. After printing, the printing table is moved again to its sheet transport position as shown in FIG. 3E, the gripper bar removes the printed sheet from the table and a next gripper bar feeds a next printing sheet to the printing table as illustrated in FIG. 3F. Then the printing table is moved again into its printing position and printing onto the next printing sheet may start. In the preferred embodiment shown in FIGS. 3A to 3F, the table positions are defined relative to a plane of the gripper bar transport. As an alternative to moving the printing table between a printing position and a sheet transport position, the gripper bars may be moved into a raised position relative to the plane of the printing table while passing over the printing table during transport of the printing sheet, and lowered to their normal position to align with the printing table for printing on the printing sheet.

Printing may start when the printing table is in the printing position, the gripper bar and therefore also the printing sheet is aligned with the printing table, and the printing sheet is supported by the printing table. As shown in FIG. 1, the print head shuttle reciprocates across the printing table in a fast scan direction, while printing on the sheet. The printing sheet remains in a fixed position during printing. The number of fast scans that are required to print a full image onto the printing sheet may depend on the details of the print head shuttle, e.g., the number and width of the print heads, and/or on the print quality targeted, e.g., the resolution or shingling/interlacing strategy used. A printed image may be obtained in one fast scan operation if the print head shuttle includes a full width print head or print head assembly. If the print head shuttle includes a print head or print head assembly with a print width smaller than the width of the sheet or the image to be printed, multiple fast scans will be required. In between two fast scans, the print head or print head assembly within the print head shuttle is shifted in a slow scan direction SS substantially perpendicular to the fast scan direction to reposition the print head or print head assembly above a non-printed or only partially printed area of the sheet. Printing methods involving shingling or interlacing strategies improve image quality at the expense of additional fast scan operations of the print head shuttle with intermediate repositioning of the print heads along the slow scan direction.

In the digital printer shown in FIG. 1, the fast scan direction of the print head is substantially perpendicular to the printing sheet transport direction. The fast scan direction may also be chosen to be in the same direction as the printing sheet transport direction. A choice of the fast scan direction may be inspired by throughput considerations. The fast scan direction may depend on the dimensions of the printing table, i.e., it may be preferable to have the fast scan direction along the same orientation as the longest dimension of the printing table, to optimize print throughput.

The digital printer as described is not limited to the use of a specific type of digital printing technique. Any type of digital print technology that can print on a printing sheet that is positioned on a substantially flat printing table can be applied. The applicable digital printing technologies may include impact printing technologies, like transfer printing, or non-impact printing technologies like ink jet printing.

A digital printer as described may be limited to monochrome printing if a single page-wide or non-page-wide print head or print head assembly is used. However, the print head shuttle may include multiple print heads or assemblies capable of printing different colors in a single fast scan operation. One of the advantages of a digital printer as disclosed is that it can offer full process color imaging in a single print station. This is considered one of the advantages of digital printing, i.e., a single printing unit may have full color printing capability. The digital printing unit may be using a 4-color print head set (Cyan Magenta Yellow blacK), a hexachrome set (Cyan Magenta Yellow Orange Green blacK), or any other combination of color sets that allows covering a given color space.

Digital Press

Figure 4A:
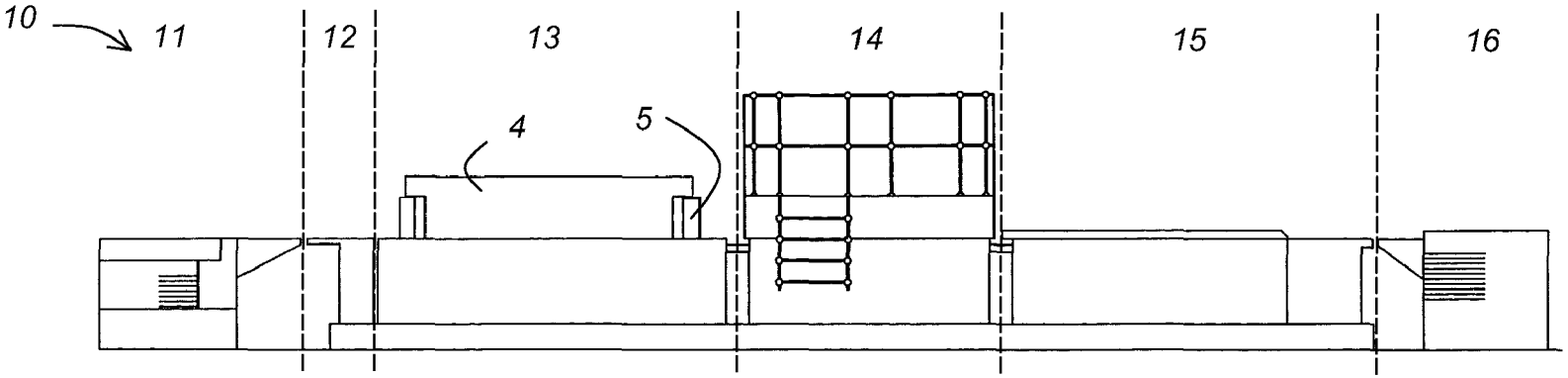
FIG. 4A shows a digital press and FIG. 4B shows the integrated printing sheet transport in the digital press according to a preferred embodiment of the present invention.

In a majority of printing techniques, conventional techniques like offset or screen printing as well as digital techniques like ink jet printing, printing inks need to be dried, cured, or fixed onto the printed sheet after printing. This may be done in various ways. The printed ink may be dried, cured, or fixed in a passive way by exposure to the environment, e.g., spontaneous drying in ambient air, or it may be dried, cured, or fixed in an active way using hot air, infra-red drying, UV exposure, or the like. The drying strategy used with a printer may depend on the type of ink, e.g., solvent inks or UV-curable inks, printer throughput, e.g., the number of prints per minute, as well as ink coverage, e.g., the amount of ink laid down on the printing sheet per square meter. The digital printer as described above and depicted in FIG. 1 can easily be extended with an active drying, curing, or fixing station, and with feeders and stackers to establish a complete printing press. An example of a complete printing press 10 is shown in FIG. 4A. On the left side of FIG. 4A is shown a printing sheet feeder 11 that presents the printing sheet to the printing sheet alignment system 12 at the input of the printing sheet transport system. Next to the printing sheet alignment system is the digital print station 13 and at the right-hand side of the digital print station is an active drying or curing station 14. On the right of the active drying or curing station, the printed sheet is laid off at the lay off station 15 and transported to a sheet stacker 16. It is clear that the active drying or curing station is optional and depends on press operating parameters, e.g., the operating inks, as discussed above. The digital print station 13 may be embodied by the digital printer 1 of FIG. 1.

Figure 4B:
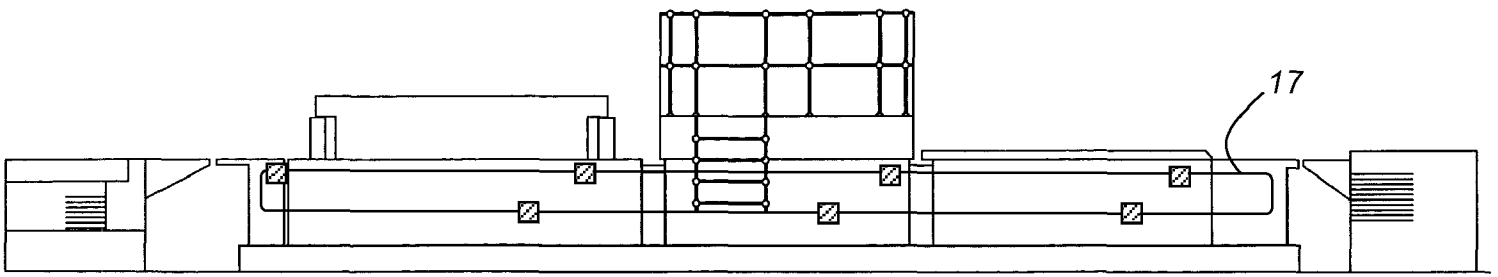

The printing sheet may be transported through the entire printing press, between the feeder and the stacker, with a single printing sheet transport system 17. The endless chain 7 as depicted in FIG. 2 may be extended to run from start to end of the press, as illustrated in FIG. 4B. A printing sheet is fed by the feeder to a sheet alignment system at the input of the printing sheet transport system. The printing sheet is aligned to a reference that is used to position the printing sheet in the digital print station and the drying or curing station. An example of such a reference may be a gripper bar as discussed above. Once the printing sheet is aligned to the gripper bar that takes hold of it, the gripper bar itself can be used as a reference to align the printing sheet in the various stations of the printing press. At the end of the printing press, a printed sheet lay off station releases the printed sheet from its reference and allows the printed sheet to be moved to the stacker with a known sheet transportation device, such as belts or suction cups. The principles of intermittent transport of the printing sheet as explained with the aid of FIGS. 3A to 3F and with reference to the digital print station, can be extended to the transport system of the entire printing press. That is, the transport system transports the printing sheet from one station to the next—halting at each station for either printing, curing, or laying off the printing sheet—and resuming the transport system to transport the sheet to the next station, if applicable, or return the gripper bar to the beginning of the printing sheet transport system. See also FIG. 4B for an illustration of how the printing sheet transport system may pull a printing sheet through the complete press.

Multifunctional Printing Press—Modular Sheet Transport

Figure 5:
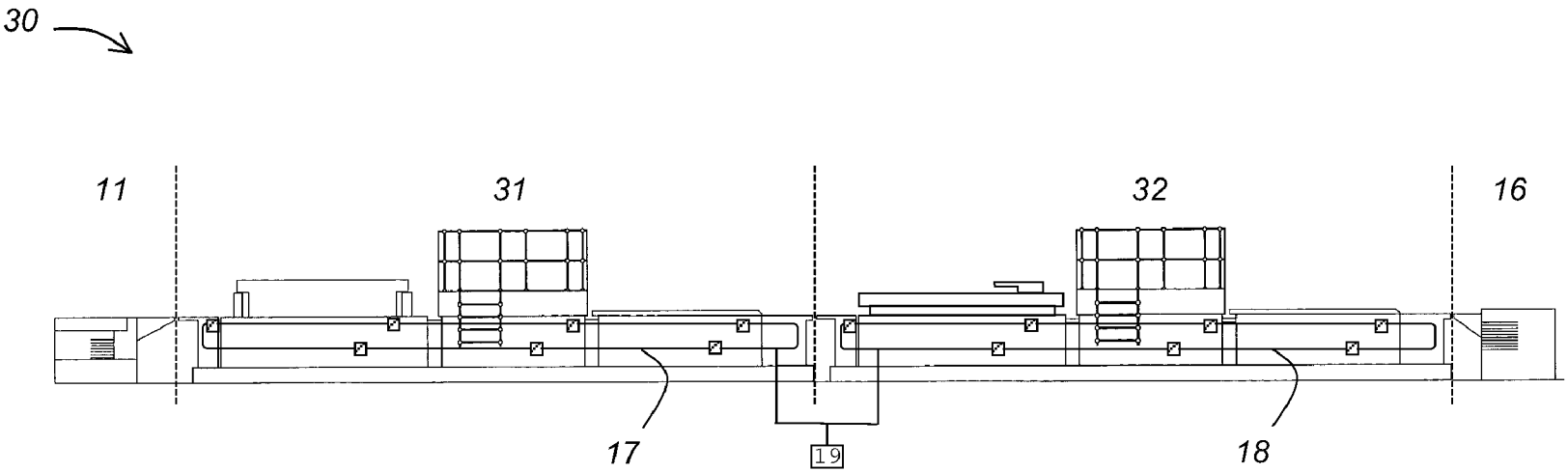
FIG. 5 shows a multifunctional printing line with modular sheet transport according to a preferred embodiment of the present invention.

The press configuration described above may be considered a standalone digital press configuration suitable for printing full color images onto sheet material. The standalone press includes a printing sheet transport system that starts with an alignment system at the input side of the printing sheet transport system and a lay off section at the opposite output side of the transport system. This feature makes the digital press suitable for mounting in line with like presses or sheet treatment stations. By "like presses or treatment stations" is meant presses or printing sheet pre/post treatment stations having a printing sheet handling system that is compatible with the constraints of the transport system of the digital press discussed above, i.e., an alignment section at the input side, a lay off section at the opposite side, and an intermittent printing sheet transport operation. By locating multiple presses and/or printing sheet treatment stations inline and synchronizing the individual printing sheet transport systems to each other with a controller, printing sheet queuing between successive presses or printing sheet treatment stations is avoided. The overall print throughput will be linked to the press or treatment station with the slowest operating cycle. The other presses or treatment stations will have to slow down their operating cycle accordingly. Inline positioning of "like presses or treatment stations" allows automatic takeover from one press or treatment station to the next, i.e., the lay off section may automatically feed the printing sheet to the alignment section of the next press or treatment station. See also FIG. 5, which shows a multifunctional printing line 30 having a digital printing press having a digital print station 31, as described above, followed inline with a screen printing press having a screen print station 32. The screen printing press may, for example, be a single module Thieme 5000 Start up! flatbed screen press, available from Thieme GmbH & Co. KG in Germany. The overall printing sheet transport system of the printing line includes a controller 19 to synchronize a chain of multiple sheet transport systems 17 and 18, thereby allowing a single printing sheet to literally run through every unit of the printing line between the feeder at the start of the line and the stacker at the end of the line.

Multifunctional Printing Press—Integrated Sheet Transport

Figure 6:
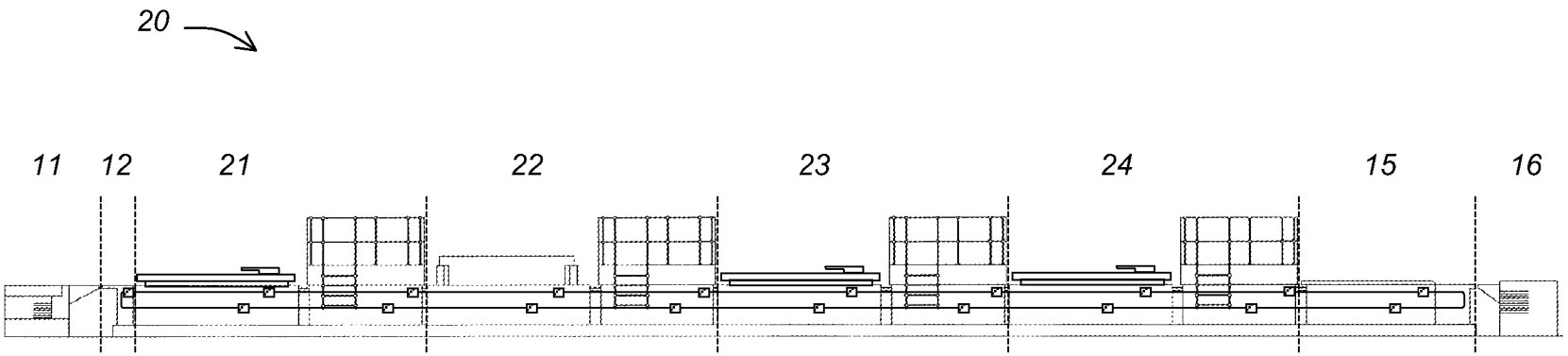
FIG. 6 shows a multifunctional printing line with integrated sheet transport according to a preferred embodiment of the present invention.

In a preferred embodiment, the multitude of printing sheet transport systems with a take-over section between each of the presses or printing sheet treatment stations is replaced by a single overall printing sheet transport. An advantage of the printing sheet transport system as shown in FIG. 2 and FIG. 4B is that the system is scalable in the length direction, i.e., the sheet transport direction, and in the width direction, i.e., the width of the gripper bars. So a single overall printing sheet transport system may run from the printing sheet feeder at the beginning of the printing line up to the printing sheet stacker at the end of the printing line. A single overall printing sheet transport system eliminates the need for take-over sections between presses or printing sheet treatment stations, further reducing complexity of the printing line and increasing throughput by eliminating non-productive printing sheet take-over time. This may result in a printing line configuration as shown in FIG. 6, to be described in more detail below. It is preferable that the gripper bars that are used to grab and transport the sheet through the press are positioned at equidistant locations along the endless chain running from start to end of the press and back. In practice, the pitch of the gripper bars along the endless chain will often equal the pitch of the multitude of stations along the printing sheet transport direction of the printing line and will often equal the sheet transport distance increment of a single cycle. A printing sheet transport system with a fixed pitch has the advantage that it allows easy integration of additional presses or stations by simple copying.

Using the extended overall printing sheet transport system and the selection of like presses or printing sheet treatment stations, the digital press as discussed in FIG. 4A, basically including a digital print station and a drying or curing station, may be extended with additional presses or pre/post treatment stations that add functionality to the digital press. Some examples may be:

A screen print station offering additional functionality regarding printing of a spot color, gloss varnish, etc.;

A sheet pre-treatment station, e.g., corona treatment, offering improved adhesion and image quality of the printed product; and A sheet post-treatment station, e.g., protective coating, offering additional protection and stability to the printed product.

Additional printing sheet treatment stations or print stations may require a dedicated drying or curing station that immediately follows the operation. In order for the additional stations to be compatible with the intermittent sheet transport of the printing line, the additional treatment of printing is executed when the sheet transport system has halted and the sheet is in a fixed position, e.g., a corona spray bar travelling across the sheet similar to the operation of the squeegee on a screen print station. So the corona spray bar or squeegee moves relative to a fixed printing sheet. This is even more preferable when flexible sheets are used because these sheets are only accurately aligned, positioned and effectively supported in the press at these stop positions. Between the stop positions the sheet is pulled or dragged through the press often with less accurate positioning. If less flexible printing sheets or rigid sheets are used, additional treatment or printing operations may be realized as page-wide stationary operations, executable while the printing sheet is transported between two successive halt positions. Using the examples above, the corona spray bar or squeegee would be operating in a stationary position while the printing sheet passes or moves relative to the corona spray bar or squeegee.

An example of an extended digital press 20 is illustrated in FIG. 6. The press has a single printing sheet transport system running between a feeder 11 and a stacker 16. From left to right the press includes a sheet pre-treatment station 21, e.g., a coating station for printing a white undercoat following a drying station to dry the undercoat layer, a 4-color digital print station 22 for printing UV-curable ink followed by a UV-curing station, a screen print station 23 for printing, e.g., a print job dependent single spot color followed by a dryer station, and at the end of the line another screen print station 24 for image-wise application of, e.g., a UV-curable gloss layer followed by a UV-curing station. The printed sheet is laid off at the lay off station 15 prior to stacking in the stacker. This configuration is only an example of a printing press according to the preferred embodiments of the present invention. It will be apparent to those skilled in the art that numerous combinations of sheet treatment, digital or conventional printing stations can be made to provide a printing press or printing line that suits the individual needs of the printer. Even without changing the printing press configuration, different types of print jobs may be run on the press. The advantage of a screen printing station in the press configuration increases the multifunctional use of the press, e.g., the single screen printing station may print a spot color A, may protect the print with a varnish B or may pre-coat the sheet with an undercoat C. The advantage of the digital print station in the press configuration is that it may replace four screen print stations.

Alternative Printing Sheet Transport

So far, the preferred embodiments of the present invention have been described with reference to a printing sheet transport system that uses gripper bars to grab the printing sheet at the beginning of the press and pull the sheet through the press up to a stacker at the end of the press.

Alternative solutions include a moving platen transport in which the printing table itself moves on a set of chains through each station of the press. The moving table may use vacuum pressure to draw the sheet down before reaching the first print station and preferably does not release the sheet until after the last station has finished a final print, treatment, drying or curing step. As with the gripper bar transport, a moving platen transport may operate as a single transport system that moves the printing sheet successively through each station in the printing press.

Instead of aligning a gripper bar to a fixed printing table, the moving table may be aligned to a fixed reference in each print station of the press upon arrival of the moving table at that station.

Apart from that, the concept of an intermittent transport with cycles according to a given cadence is maintained.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A method for printing comprising the steps of:

feeding a printing sheet in a first transport direction to a digital print station using a first printing sheet transport system;

raising a print table to a printing position to receive the printing sheet thereon;

digital printing a first ink on the printing sheet in the digital print station while the printing sheet is maintained in a fixed position on the print table;

lowering the print table to a sheet transport position;

removing the printing sheet in the first transport direction from the digital print station using the first printing sheet transport system; wherein the method further includes the steps of:

releasing the printing sheet from the first transport system before the digital printing; and taking hold of the printing sheet again using the first printing sheet transport system after the digital printing; wherein the first sheet transport system includes a gripper.

2. The method according to claim 1, further comprising the steps of:

feeding the printing sheet to a screen print station;

screen printing a second ink on the printing sheet in the screen print station, the screen printing being performed prior to or after the digital printing on the printing sheet;

removing the printing sheet from the screen print station; wherein the steps of feeding and removing the printing sheet to and from the screen print station are automated using a second printing sheet transport system and occur in a second transport direction.

3. The method according to claim 2, wherein the steps of feeding and removing the printing sheet to and from each of the print stations are synchronized with a printing sheet feed cycle.

4. The method according to claim 1, wherein the step of digital printing includes reciprocating a shuttle having a printhead for printing the first ink on the printing sheet in a fast scan direction across the printing sheet.

5. The method according to claim 4, wherein the fast scan direction is substantially perpendicular to the first transport direction.

6. The method according to claim 1, wherein the step of digital printing the first ink on the printing sheet includes jetting the first ink using an ink jet printhead.

7. The method according to claim 1, further comprising the step of:

aligning the printing sheet in the digital print station using the gripper as a reference.

8. The method according to claim 1, further comprising the step of:

withdrawing the gripper from the digital print station before the digital printing.

* * * * *